US006277002B1

(12) United States Patent
Leadbeater

(10) Patent No.: US 6,277,002 B1
(45) Date of Patent: Aug. 21, 2001

(54) GRINDING MACHINE SPINDLE

(75) Inventor: Peter Brian Leadbeater, Milton Keynes (GB)

(73) Assignee: Unova U.K. Limited, Aylesbury (GB)

( * ) Notice: Subject to any disclaimer, the term of this patent is extended or adjusted under 35 U.S.C. 154(b) by 0 days.

(21) Appl. No.: 09/462,027

(22) PCT Filed: Jun. 23, 1998

(86) PCT No.: PCT/GB98/01836

§ 371 Date: Dec. 30, 1999

§ 102(e) Date: Dec. 30, 1999

(87) PCT Pub. No.: WO99/02306

PCT Pub. Date: Jan. 21, 1999

(30) Foreign Application Priority Data

Jul. 10, 1997 (GB) ..... 9714427

(51) Int. Cl.[7] ..... B24B 1/00
(52) U.S. Cl. ..... 451/57; 451/273
(58) Field of Search ..... 451/48, 272, 273, 451/276, 57; 408/36, 118

(56) References Cited

U.S. PATENT DOCUMENTS 3,778,179 * 12/1973 Rivas ..... 408/206
3,885,925 5/1975 Tatar .

FOREIGN PATENT DOCUMENTS 57-168856 10/1982 (JP) .

* cited by examiner

*Primary Examiner*—Timothy V. Eley
*Assistant Examiner*—Dung Van Nguyen
(74) *Attorney, Agent, or Firm*—Lee, Mann, Smith, McWilliams, Sweeney & Ohlson

(57) ABSTRACT

A machine tool, particularly for grinding workpieces, has a single rotatable spindle (2) carrying a fixed cup-shaped inner grinding wheel (8) and an axially slidable cup-shaped outer grinding wheel (22). A T-shaped annular piston (14) engages in a recess with the spindle to form front and rear annular chambers to each of which hydraulic oil is alternately connectable. The piston has an outer part (18) on which is mounted the grinding wheel (22), being preferably the coarser of the two wheels for use in rough grinding. A tooth-shaped location device (32) at each side of the piston (14) engages with a respective device (34) on the spindle to prevent relative rotation of the wheel (22) and to provide a driving torque when it is advanced to its working position beyond the inner wheel (8).

17 Claims, 2 Drawing Sheets

GRINDING MACHINE SPINDLE

FIELD OF THE INVENTION

This invention relates to machine tools and particularly to a machine tool in which material is removed from a workpiece by engagement with a rotating tool, more particularly a grinding wheel.

BACKGROUND TO THE INVENTION

In many grinding processes, eg. in the manufacture of cams and crankshafts, it is usual for the initial major grinding operation to be performed by rough grinding using a coarse grade grinding wheel and for the final grinding operation to be performed by a fine grade grinding wheel. If the whole grinding process is to be performed on a single machine then two main options are available: either the machine has a single spindle which means that at each successive grinding operation the coarse wheel must be replaced by the fine wheel and vice versa, which significantly increases the total time required to grind a component; or alternatively the machine must be designed to have two spindles carrying respectively coarse and fine grinding wheels, which considerably increases the complexity and hence cost of the grinding machine.

It is an object of the present invention to produce an improved method of and apparatus for grinding, in which the coarse rough and final grinding operations are performed on a single spindle of a machine tool.

SUMMARY OF THE INVENTION

According to the present invention there is provided a machine tool having a single rotatable spindle on which is mounted a first cutting tool at a fixed position relative to the spindle and a second cutting tool adjacent the first tool, and slide means for slidably moving the second tool relative to the first tool to either retract the second tool or to extend it into an operational position.

Advantageously the first and second tools are disposed at one end of the spindle, the slide means moving the second tool in a direction axial of the rotational axis of the spindle, so that the tools successively engage axially with a workpiece.

In this arrangement the second tool is preferably mounted radially outside the first tool.

The first and second tools may be first and second grinding wheels, in particular cup-shaped grinding wheels. Since small errors may occur in the positioning of the second grinding wheel, the latter is preferably the coarse wheel for rough grinding while the first wheel is the finishing wheel.

The slide means may comprise an annular member and activating means for moving the annular member between forward and retracted positions.

The annular member is preferably radially inwardly directed for slidably engaging with a first cylindrical outer surface of the spindle.

Preferably the annular member is arranged in the form of an annular piston, the spindle forming an annular chamber at each side of the piston.

Where the radial element is an annular piston, the activating means may comprise means for feeding fluid under pressure to either one side or the other of the piston. The fluid may be hydraulic oil or more preferably air under pressure which is fed through passages in the spindle to ports extending respectively into the two annular chambers.

The annular piston may incorporate a sealing ring eg. of resiliently deformable material, which is sealingly engagable with the first outer surface of the spindle.

The annular piston may be generally T-shaped in section, there being an outer annular limb on each side of the piston, the limb which is adjacent the first tool carrying the second tool.

The limbs may slidably engage with respective second cylindrical outer surfaces of the spindle.

The second outer surfaces may similarly incorporate sealing rings eg. of resiliently deformable material to sealingly engage with the respective limbs of the piston.

The piston preferably carries a location device at each side for engaging with respective location devices in the spindle, so that the piston is prevented from rotating relative to the spindle at each extremity of its sliding movement.

The location means may take the form inter-engaging teeth, which provide both radial and axial location.

Means may also be provided to prevent rotation of the piston relative to the spindle during sliding movement. This may take the form of a pin formed on the spindle or piston which is engagable with a corresponding hole in the piston or spindle respectively.

The invention also extends to a method of machining a workpiece using a single spindle machine tool, comprising mounting a first cutting tool fixedly to the end of a spindle and mounting on the spindle a second cutting tool for axial sliding movement relative to the first tool, and further comprising the steps of extending the second tool into its operating position, rough machining the workpiece with the second tool, retracting the second tool, and finish machining the workpiece with the first tool.

In the preferred method the first and second tools are cup-shaped grinding wheels, the second wheel being the rough grinding wheel.

BRIEF DESCRIPTION OF THE DRAWING

An embodiment of the invention will now be described, by way of example only, with reference to the accompanying drawings, in which.

DETAILED DESCRIPTION

Figure 1:
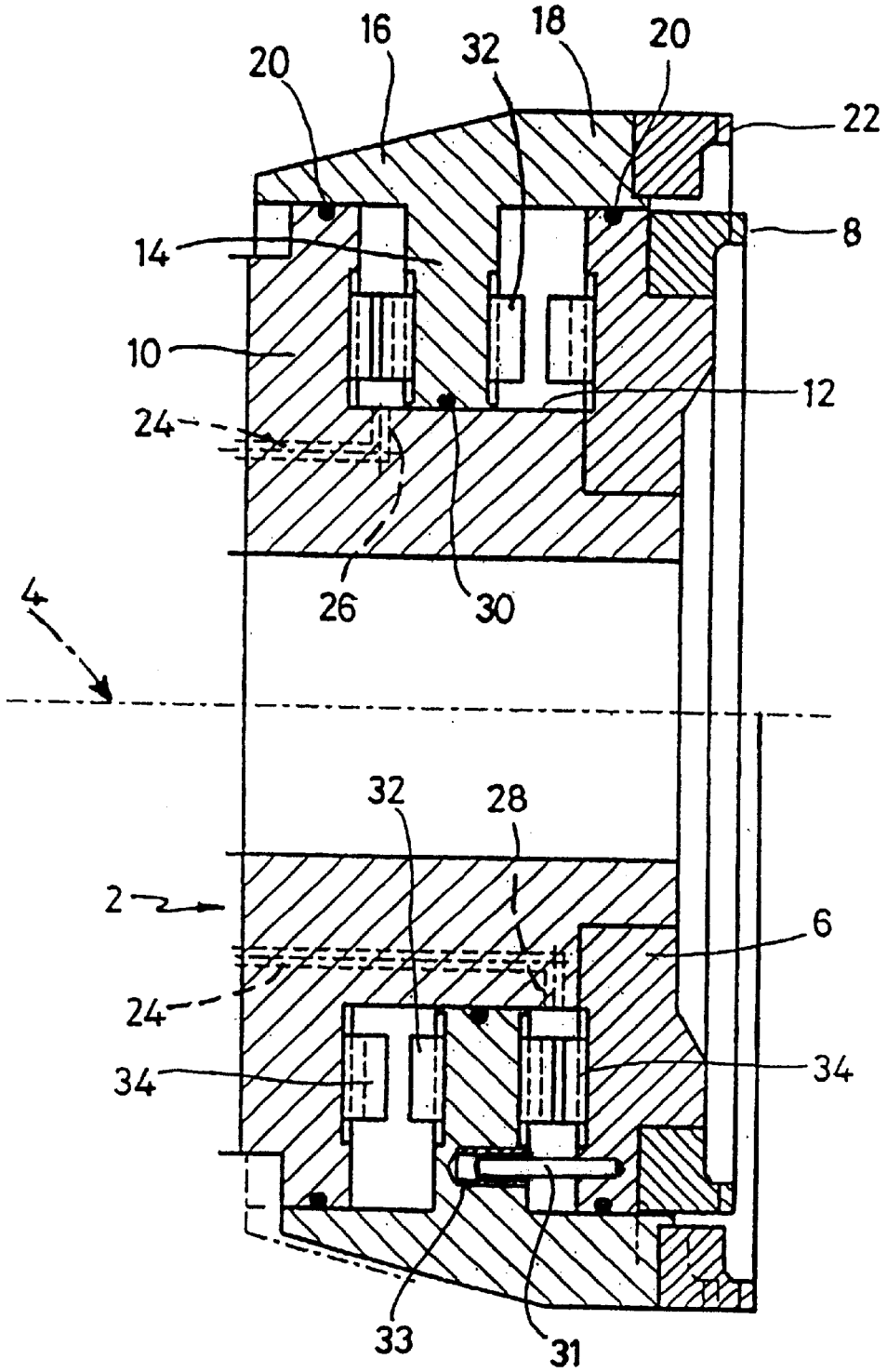
FIG. 1 is a schematic section through a single spindle dual wheel grinding unit.

The grinding unit shown generally by the reference 1, has a spindle end 2 which is rotatable about an axis 4. At the front end of the spindle there is secured a mounting ring 6 which carries a cup-shaped grinding wheel 8 of a fine grade suitable for finish grinding.

Between a rear flange 10 of the spindle and the mounting ring 6, the spindle is formed with a smooth cylindrical outer surface 12 along which an annular piston 14 is slidable.

The piston is T-shaped in section, having rearward and forward outer limbs 16 and 18 respectively.

The rear flange 10 has a smooth cylindrical outer surface which is of the same diameter as a corresponding smooth outer surface of the mounting ring 6 and each carries a sealing ring of resilient deformable material 20. The sealing rings engage with internal cylindrical surfaces of the limbs 16 and 18 respectively.

The outer surface of the limb 18 carries a cup-shaped grinding wheel 22 for rough grinding.

The piston 14 thus forms with the rear flange 10 on the one side, and the mounting ring 6 on the other side, two respective annular chambers.

Passageways 24 are formed in the spindle which lead to rearward and forward ports 26 and 28 for feeding hydraulic oil under pressure to the respective sides of the piston 14. Thus in use the grinding wheel 22 can be moved from a rearward position, as shown at the top of the figure, to a forward position shown at the bottom of the figure.

To prevent hydraulic oil leaking along the surface 12 under the piston, the piston is similarly provided with a sealing ring 30.

A location device 32 is mounted on each side of the piston for engaging with a corresponding location device 34 mounted on the rear flange 10 and mounting ring 6 respectively. The location devices provide not only accurate axial and radial location, but also provide a reliable method of transmitting torque to the grinding wheel 22. The location devices are in the form of inter-engaging teeth.

In order to prevent rotation occurring as the piston 14 moves from one side to the other, a pin 31 and corresponding hole 33 is provided between the piston and the respective rear flange/mounting ring. A sufficient clearance is provided about the pin to ensure that the location devices 32, 34 also provide a radial location in addition to the axial location of the piston.

In some applications a pneumatic operation may be preferred in place of the hydraulics described above.

Although not shown, suitable scrapers may be provided on the outwardly facing side of the rear flange 10 and of the mounting ring 6, or on the limbs 16 and 18. The scrapers prevent the ingress of dirt or fluid (eg. cutting fluid), which could damage the sealing rings 20.

Suitable fixing means are provided to enable the grinding wheels 8 and 22 to be replaced.

To ensure that the correct advance and retraction of the piston has occurred, a proximity or position sensor (not shown) is mounted preferably in the wheelguard of the machine.

Since the location devices 32, 34 are mounted within the hub of the spindle, they are able to be kept perfectly clean.

Figure 2:
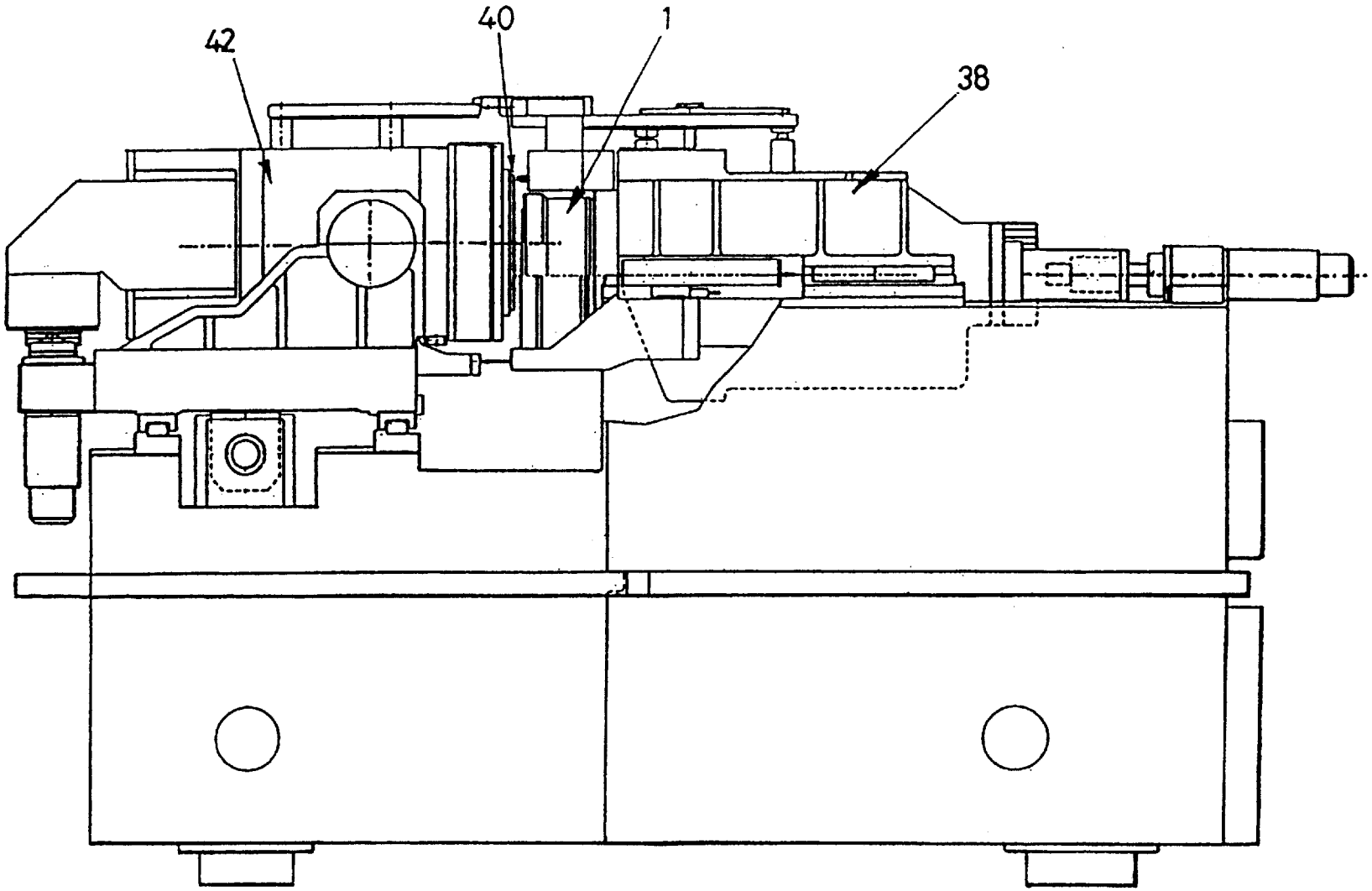
FIG. 2 is an elevation of a face grinding machine in which the unit of FIG. 1 is mounted.

The grinding unit 1 is mounted in a face grinding machine as shown in FIG. 2. The driven end of the spindle is shown generally at 38.

Opposite the unit 1 a workpiece 40, such as a wafer disc, is rotatably mounted on a work spindle 42. Thus the workpiece can be engaged successively by the rough grinding wheel 22 and then by the grinding wheel 8 for finish grinding.

It will be apparent that the single spindle grinding machine described is able to exert a sufficiently high force against a workpiece, allowing high torque transmission and precision location. Since there is only a single spindle, the grinding machine is of compact design, and less costly than a twin spindle machine.

What is claimed is:

1. A machine tool having a single rotatable spindle on which is mounted a first cutting tool at a fixed position relative to the spindle and a second cutting tool adjacent the first tool, and slide means for slidably moving the second tool relative to the first tool to either retract the second tool or to extend it into an operational position, said slide means comprising an annular member and activating means for moving the annular member between forward and retracted positions, wherein the annular member is in the form of an annular piston, being radially inwardly directed for slidably engaging with a first cylindrical outer surface of the spindle, the spindle forming an annular chamber at each side of the piston.

2. A machine tool according to claim 1 in which the first and second tools are disposed at one end of the spindle, the slide means moving the second tool in a direction axial of the rotational axis of the spindle, so that the tools successively engage axially with a workpiece.

3. A machine tool according to claim 2, in which the second tool is mounted radially outside the first tool.

4. A machine tool according to claim 1 in which the first and second tools are first and second grinding wheels, in particular cup-shaped grinding wheels.

5. A machine tool according to claim 4 in which the second grinding wheel is the coarse wheel for rough grinding, while the first wheel is the finishing wheel.

6. A machine tool according to claim 1 in which the activating means comprises means for feeding fluid under pressure to either one side or the other side of the annular piston.

7. A machine tool according to claim 6 in which the fluid is hydraulic oil or air under pressure which is fed through passages in the spindle to ports extending respectively into the two annular chambers.

8. A machine tool according to claim 1 in which the annular piston incorporates a sealing ring of resiliently deformable material, which is sealingly engagable with the first outer cylindrical surface of the spindle.

9. A machine tool according to claim 1 in which the annular piston is generally T-shaped in section, there being an outer annular limb on each side of the piston, the limb which is adjacent the first tool carrying the second tool.

10. A machine tool according to claim 9 in which the limbs slidably engage with respective second cylindrical outer surfaces of the spindle.

11. A machine tool according to claim 10 in which the second outer surfaces similarly incorporate sealing rings of resiliently deformable material to sealingly engage with the respective limbs of the piston.

12. A machine tool according to claim 1 in which the piston carries a location device at each side for engaging with respective location devices in the spindle, so that the piston is prevented from rotating relative to the spindle at each extremity of its sliding movement.

13. A machine tool according to claim 12 in which the location devices take the form of inter-engaging teeth which provide both radial and axial location.

14. A machine tool according to claim 1 further comprising guide means to prevent rotation of the piston relative to the spindle during sliding movement.

15. A machine tool according to claim 14 in which the guide means comprises a pin formed on the spindle or on the piston and which is engagable with a corresponding hole in the piston or spindle respectively.

16. A method of machining a workpiece using a single spindle machine tool, comprising mounting a first cutting tool fixedly to the end of a spindle and mounting on the spindle a second cutting tool for axial sliding movement on said spindle relative to the first tool, and further comprising the steps of slidingly extending the second tool axially into its operating position, rough machining the workpiece with the second tool, axially retracting the second tool, and finish machining the workpiece with the first tool.

17. A method according to claim 16 in which the first and second tools are cup-shaped grinding wheels, the second wheel being the rough grinding wheel.

* * * * *